US005421966A

United States Patent [19]

Oxley

[11] Patent Number: 5,421,966

[45] Date of Patent: Jun. 6, 1995

[54] ELECTROLYTIC REGENERATION OF ACID CUPRIC CHLORIDE ETCHANT

[76] Inventor: James E. Oxley, 71 Edgehill Rd., New Haven, Conn. 06511

[21] Appl. No.: 159,517

[22] Filed: Dec. 1, 1993

[51] Int. Cl.[6] ..... C25B 1/26

[52] U.S. Cl. ..... 204/94; 204/106; 204/130; 204/228; 204/DIG. 13; 204/267

[58] Field of Search ..... 204/94, 106, 149, 151, 204/228, 252, 253, 283, 284, 130, DIG. 13

[56] References Cited

U.S. PATENT DOCUMENTS

| | | | |
|---|---|---|---|
| 2,964,453 | 12/1960 | Garn | 204/130 |
| 4,071,429 | 1/1978 | Wagenknecht | 204/231 |
| 4,107,011 | 8/1978 | Kucherenko | 204/151 |
| 4,468,305 | 8/1984 | Hills | 204/130 |
| 4,604,175 | 8/1986 | Navmov | 204/151 |
| 4,692,228 | 9/1987 | Twardowski | 204/105 R |
| 5,085,730 | 2/1992 | Cordani | 156/642 |

OTHER PUBLICATIONS

Louis H. Sharpe, Paul D. Garn, "Regenerable Etchant for Copper," *Industrial and Engrg. Chem.*, vol. 51, No. 3, Mar. 1959.

*Primary Examiner*—John Niebling
*Assistant Examiner*—Brendan Mee
*Attorney, Agent, or Firm*—Breiner & Breiner

[57] ABSTRACT

An electrolytic apparatus and process for the on-line regeneration of acid cupric chloride etching baths used in printed circuit board fabrication is described. The apparatus utilizes a regeneration process which exactly reverses the reaction $Cu+CuCl_2 \rightarrow 2CuCl$ in order that the copper metal etched into the system is completely removed while at the same time maintaining the concentration of cuprous and cupric chloride within the desired range. A preferred system utilizes a flow-through graphite or carbon anode and a flow-by cathode, allowing for more precise control of current/potential variables. The cell utilizes low operating voltage resulting in less waste heat generation and lower electrical costs and improved on-line process control, leading to improved operating efficiencies and reliability in terms of unscheduled maintenance and outages.

7 Claims, 6 Drawing Sheets

ELECTROLYTIC REGENERATION OF ACID CUPRIC CHLORIDE ETCHANT

FIELD OF INVENTION

This invention relates to an electrolytic process for the on-line regeneration of acid cupric chloride etching baths, used in printed circuit board fabrication, and to an apparatus for practicing the process. According to the process, depleted etchant from an etching machine is continuously circulated through an external electrolysis cell which both maintains the etchant composition and recovers the copper metal etched from the circuit boards. The apparatus is compact and capable of low cost maintenance, and the process is highly efficient.

BACKGROUND OF INVENTION AND RELATED ART

Chemical regeneration of acid cupric chloride etching baths utilizes schemes to re-oxidize cuprous to cupric, via for example the reactions:

$$2CuCl+Cl_2=2CuCl_2 \quad (1)$$

$$2CuCl+H_2O_2+2HCl=2CuCl_2+2H_2O \quad (2)$$

Although such batch-processes are acceptable from the standpoint of extending the life of etching baths, they result in a net increase in solution inventory, which must eventually be disposed of. Strong environmental concerns and cost incentives exist for development of an efficient electrolytic regeneration process for these etching solutions. It is estimated that an effective electrolytic regeneration process would currently eliminate the hauling and disposal of over 20 million gallons of spent etchant per year in the United States alone.

Accordingly, several attempts have been made to develop electrolytic processes for the regeneration of acid cupric chloride etchant. These processes all suffer the drawbacks of high cost, poor efficiency and overall design complexity. In order to better understand the essential characteristics of these processes together with their inherent drawbacks, it is helpful to review the basic electrochemical principles which are pertinent to an electrolytic regeneration process. It is to be understood, however, that this discussion is not acknowledged prior art, but background for the invention only.

Thus, the overall reaction during etching of copper by cupric chloride/hydrochloric acid is:

$$Cu+CuCl_2=2CuCl \quad (3)$$

The electrode reactions relevant to the etching and electrolytic regeneration processes are:

$$Cu^+ = Cu^{++} + e \qquad E^o = +0.153\ V \quad (4)$$

$$Cu = Cu^+ + e \qquad E^o = +0.521\ V \quad (5)$$

$Cu^+$ ions are strongly complexed in the presence of excess chloride ions, mainly via the reaction:

$$CuCl+Cl^-=CuCl_2 \quad (6)$$

A consequence of this complexation is that the thermodynamic activity of $Cu^+$ is significantly reduced so that reaction (4) takes place at a more positive potential, while reaction (5) takes place at a correspondingly more negative potential. Depending on the degree of complexation, the relative position of the potentials of these two reactions becomes inverted so that reaction (4) occurs at a more positive potential than reaction (5). This leads to the spontaneous etching of copper, wherein reaction (4) goes from right to left and reaction (5) goes from left to right, leading to the overall reaction shown by equation (3).

The overall anodic and cathodic electrode reactions accompanying electrolytic regeneration can be written as follows:

$$\text{Anode} \quad 2Cu^+ = 2Cu^{2+} + 2e \quad (7)$$

$$\text{Cathode} \quad Cu^{2+} + e = Cu^+ \quad (8)$$

$$\underline{Cu^+ + e = Cu} \quad (9)$$

$$\underline{Cu^{2+} + 2e = Cu} \quad (10)$$

$$\text{Overall} \quad 2Cu^+ = Cu + Cu^{2+} \quad (11)$$

The overall reaction thus comprises the anodic oxidation of $Cu^+$ to $Cu^{2+}$, and the cathodic reduction of $Cu^+$ to Cu metal. In the absence of $H_2$ or $Cl_2$ evolution, as will be apparent hereinafter, the only possible source of coulombic inefficiency, in terms of the above reactions, will occur if any of the $Cu^+$ formed by reaction (8) diffuses into the bulk of the electrolyte instead of being directly reduced to Cu metal.

Reactions (8) and (9) are consecutive electrochemical reactions. The key to successful electrolytic regeneration is that the limiting current for reaction (8) is exceeded, forcing the succeeding reaction (9) to take place. At the same time, the limiting current for reaction (7) must not be exceeded, so that the next electrochemical oxidation process, namely chlorine evolution, is avoided. Similarly, in order to avoid the occurrence of $H_2$ evolution at the cathode, the limiting current for the combined reactions (8) and (9) must not be exceeded.

The standard potentials for the hydrogen and chlorine evolution reactions are more negative and more positive, respectively, than either the cupric or cuprous ion reactions above, namely, $$H_2 = 2H^+ + 2e \qquad E^o = 0 \quad (12)$$

$$2Cl^- = Cl_2 + 2e \qquad E^o = +1.359\ V \quad (13)$$

The occurrence of these reactions can in principle be avoided by careful control of solution mass transfer and current density as will be hereinafter established.

Moreover, in a commercial spray etcher, depending on fluid tightness of the spray etcher design, it is inevitable that there will be some degree of oxygen ingress which, if unchecked, will gradually consume both CuCl and HCl according to reaction (14), $$O_2+4HCl+4CuCl=4CuCl_2+2H_2O \quad (14)$$

This reaction will have the effect of driving the redox potential positive. It also leads to a net growth in solution inventory, analogously to the chemical regeneration schemes which electrolytic regeneration seeks to avoid. Although this effect will be alleviated to some extent by drag-out, this is not sufficient in a well designed spray etcher system. Furthermore, it is important to avoid such losses in order to minimize the need for off-line waste treatment. The magnitude of oxygen ingress can be as much as 5% of the copper throughput at the spray etcher, and there will thus be an overall current efficiency penalty of the same magnitude.

In what is believed to have been the first effort to develop a commercial electrolytic system for regeneration of an acid cupric chloride etching bath, Parikh and coworkers [*Metal Finishing*, p. 42, March 1972; U.S. Pat. No. 3,784,455], following an earlier patent by Garn and Sharpe [U.S. Pat. No. 2,964,453], devised an arrangement in which the cathode consisted of a bundle of cylindrical rods, and the anode was planar graphite. The (immersed) anode to cathode area ratio was between five and six to one. The cathode rods were arranged so that they could be sequenced into and out of the electrolyte. While the rods were external to the electrolyte, electrodeposited copper could be scraped off.

More recently, a system has been proposed by R. Ott and H. Reith [U.S. Pat. No. 4,508,599] wherein the cathode is configured as a narrow rotating wheel, having an outer titanium band, the sides of the wheel being of nonconductive plastic. The cathode wheel is rotated slowly within a semicircular vessel having a coating of mixed transition metal oxides as catalyst for the anodic oxidation reaction. The relative areas of the anode and cathode were set at 7.5:1. Copper metal was scraped off the cathode during the period that the titanium surface was external to the electrolyte. In each of the examples described above, the anolyte and catholyte are common to each other.

Another system described by Hillis [*Soc. Chem. Ind.*, p. 91 (1980); U.S. Pat. No. 4,468,305] employs separate anolyte and catholyte flow loops having different electrolyte compositions, the catholyte being approximately 10 times more dilute in copper than the anolyte. In this way, the need for different anode and cathode areas is avoided since the limiting current for $Cu^{2+}$ going to $Cu^{+}$ is exceeded simply by virtue of the electrolyte concentration difference. Electrode separation is provided in this case by a cation exchange membrane. Electrodeposited copper was removed from the cathodes by means of a scraping mechanism.

The above-described processes and apparatus each have serious drawbacks, including having different anode and cathode areas suffering the problem of uneven current distribution. The latter translates directly into uneven potential distribution, particularly at the anode, which can render it impossible to avoid parasitic $Cl_2$ evolution at those regions farthest removed from the cathode. Waste heat generation stemming from iR losses is excessive in each case, as a direct consequence of the high operating voltages, namely 5 to 8 volts. This results in the need for costly heat exchangers in addition to being an additional operating cost burden. The anodes employed in each of the examples noted above are all flow-by electrodes which are inherently inefficient and restrict freedom in selection of design parameters.

SUMMARY OF INVENTION

The present invention utilizes a regeneration process which exactly reverses reaction (3), i.e., $Cu+CuCl_2=2CuCl$, such that copper metal etched into the system is continuously removed, while at the same time the concentrations of cuprous and cupric chloride are maintained within the desired range. At the anode, $Cu^{+}$ is oxidized to $Cu^{2+}$. At the cathode, Cu metal is electrodeposited via the simultaneous reduction of $Cu^{2+}$ to $Cu^{+}$ and the reduction of $Cu^{+}$ to Cu.

With common anolyte and catholyte, this is accomplished while avoiding parasitic $Cl_2$ or $H_2$ evolution by exceeding the limiting current for reduction of $Cu^{2+}$ to $Cu^{+}$, for example by arranging for a much higher real current density at the cathode than at the anode, e.g., in the prior art, by the use of a smaller cathode than anode. If the real current densities were the same, only reaction (4) would take place, going from left to right at the anode and right to left at the cathode, with no net regeneration.

An alternative embodiment, which is the preferred embodiment and the primary feature of the present invention, is to employ a porous flow-through anode. This electrode provides the necessary increased surface area, but the area is internal to the electrode structure. Flow-through electrodes have been found to offer considerably improved efficiency compared to flow-by electrodes in terms of solution-phase mass-transfer. At the same time, a more straightforward and cost effective, parallel plate and frame design, in which the cross sectional areas of the anode and cathode are the same, becomes possible. This allows for more precise control of current/potential variables. Voltaic efficiencies can thus be maximized and parasitic reactions, i.e., $Cl_2$ and $H_2$ evolution, can be avoided.

The choice of electrode materials according to this invention can be varied and is governed partly by the corrosive nature of the HCl-based electrolyte. The materials employed must be inert to the chemicals involved, both in the absence of and during current flow. Graphite and carbon fulfill these requirements and are preferred materials for both the anode and the cathode. A requirement for the cathode is that the copper not adhere too strongly. Other materials which can be employed are based on chemically inert metals such as titanium. Thus, sheet titanium can serve as the cathode, while titanium coated with a transition metal oxide catalyst can serve as the anode.

Graphite or carbon felt, suitable for use as a flow-through electrode, is available, for example, from the Fiber Materials Corporation in Biddeford, Maine. This material has sufficiently low electrical resistivity, even when bonded to a graphite or carbon plate, that potential drops are minimal even at the relatively high current densities (100 to 150 $mA/cm^2$) which may be required in practice. Electrolyte is preferably flowed longitudinally through the graphite felt anode, and across the surface of the graphite, carbon, or titanium plate cathode.

By means of a porous flow-through anode and a planar flow-by cathode, mass transport and real current density can be controlled by independent adjustment of the flow rate and electrode thickness, respectively, the coulombic efficiency for copper deposition being maximized at low flow rates, while the anode efficiency is maximized at high flow rates. Since a common electrolyte can be employed, a separator is needed only for mechanical separation of the electrodes to separate the anolyte and catholyte flows and to minimize the occurrence of convective crossover.

The advantages of the electrolytic regeneration of this invention which translate into lower cost include lower operating voltage, hence less waste heat generation and lower kWh costs; and improved on-line process control, leading to both improved operating efficiencies and reliability in terms of unscheduled maintenance and outages.

A further object of the present invention is to provide an auxiliary cell for utilization with the electrolytic regenerator to reverse the effect of oxygen ingress. Thus, for convenience in understanding how the effects of oxygen ingress can be reversed, equation (14) set forth hereinbefore, albeit a homogeneous reaction, may be split into its component anodic and cathodic half-cell reactions as follows:

| | | |
|---|---|---|
| Cathodic | $O_2 + 4H^+ + 4e = 2H_2O$ | (15) |
| Anodic | $4Cu^+ = 4Cu^{2+} + 4e$ | (16) |
| Overall | $O_2 + 4H^+ + 4Cu^+ = 4Cu^{2+} + 2H_2O$ | (17) |

Equation (17) is identical to equation (14), with the invariant $Cl^-$ ions being omitted. What is required, therefore, in order to reverse this reaction is an auxiliary cell wherein the anodic reaction is oxygen evolution (reaction 15, right to left) and the cathodic reaction is $Cu^{2+}$ reduction to $Cu^+$ (reaction (16), right to left). In principle, this could be accomplished by means of a low oxygen over-voltage anode, i.e., one which minimizes the chlorine evolution reaction at reasonable current densities, in conjunction with a flow-by cathode operated below the limiting current for $Cu^{2+}$ ion reduction. Achieving the latter is not difficult due to the high concentration of $Cu^{2+}$. However, the former is more difficult, and although certain materials do exist which tend to favor oxygen evolution, it is impossible to exclude the occurrence of chlorine evolution, particularly at higher current densities.

According to the present invention, the auxiliary cell is to be located in a separate flow loop connected with the sump of the spray etcher. The auxiliary cell reverses the effect of oxygen ingress, and while reducing the net current or coulombic efficiency of the electrochemical regenerator, the overall net effect is beneficial. Accordingly, a divided, proton permeable membrane cell, in a separate loop from the main electrolyzer is provided. Electrolyte from the spray etcher sump flows through the cathode chamber, where the reaction is $Cu^{2+} + e = Cu^+$. The cell is preferably fitted with an electropermeable membrane material developed by the T & G Corporation in Lebanon, Conn. and described in U.S. Pat. No. 4,797,190. These materials are unique composites, consisting of a hydrogel dispersed in an inert nonporous plastic matrix. Numerous examples of such materials are possible depending upon the choices of hydrogel and plastic matrix. The membrane precursor may be prepared in the form of a water-based emulsion which can be applied as an adherent coating to any of a wide variety of other separator or membrane materials known in the art. The particular material preferred for use in the auxiliary cell of the present invention displays the unique property of being selectively permeable to protons when these ions are liberated at the anode during the process of Oxygen evolution (see equation 15). Other ionic species do not pass through the membrane under these conditions, or, put in another way, the transport number of the proton is equal to unity. Nonionic solvent species, for example water, are similarly prevented from being transported through the membrane. Moreover, under open circuit conditions, no cross-over of any of the species contained in the electrolyte occurs. Thus, the membrane does not display the Donnan effect. The anode chamber will contain, for example, $H_2SO_4$, and the anode reaction is oxygen evolution. Make-up water is added periodically to the anolyte. The cathode is constructed of, for example, planar graphite or carbon; and the oxygen evolution anode is made from a number of materials known to the art, an example of a suitable material being Pt-clad niobium.

As evident from equation 14, the only independent variable accessible for control of auxiliary cell operation is the concentration of HCl. It is thus necessary to conduct periodic analyses of this parameter in order to provide the basis for adjusting the auxiliary cell current. The frequency of analysis will be determined by the constancy of the oxygen ingress, which will be a function both of spray etcher design and board throughput rate.

PRESENTLY PREFERRED EMBODIMENT AND DRAWING

The present invention having been defined in general terms will be described in detail with reference to the drawing and presently preferred embodiments. In the drawing, FIG. 1 is a schematic drawing of a flow loop which demonstrates the operating principles of the present invention;

Figures 1, 2:
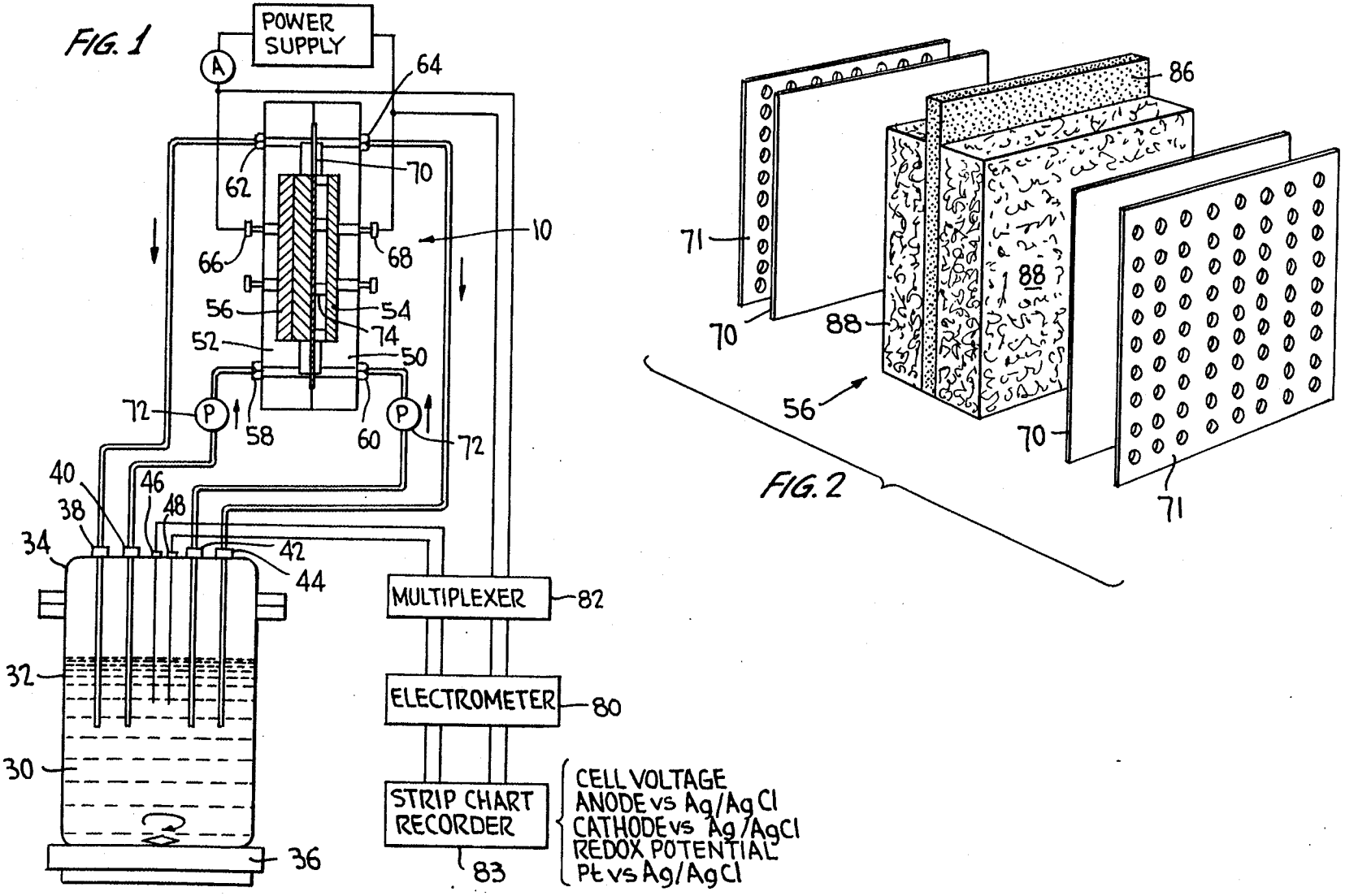
FIG. 2 is an exploded view of a simplified flow-through anode assembly useful according to the present invention.

The flow loop shown in FIG. 1 illustrates the key elements of the invention. The electrolyte reservoir vessel 30 is the sump in a conventional spray etching machine, and is sized so as to match the plate area of the electrolysis cell 10 and thus correspond with required etchant regeneration rates. For control purposes, a closed system was employed to avoid any interaction of the electrolyte with atmospheric oxygen via reaction (14) set forth hereinbefore. A standard 2 liter Pyrex reaction kettle 32 with a flanged cover 34 fitted with standard tapered joints is utilized. Temperature control (±1° C.) and mixing are accomplished by placing the reservoir on a conventional heat element/stirrer 36. The cover has four tubing ports 38, 40, 42, 44, each fitted with O-ring adapters, two for the anolyte loop and two for the catholyte loop. Two additional ports 46 and 48 accommodate an Ag/AgCl reference electrode and a platinum indicator electrode, respectively. An additional port, not shown on the schematic, provides access for temperature measurement, addition of copper metal to adjust the redox potential, or gas sparging as needed.

The electrolytic cell 10 consists of two acrylic halves 50 and 52 machined to provide cavities for the anode 56 and cathode 54, electrolyte flow channels for entries 58 and 60 and exits 62 and 64, and electrical connections 66 and 68 via titanium screws at the back of each electrode. The anode 56 and cathode 54 are separated by a microporous Daramic separator 70. Daramic, marketed by W. R. Grace, is a microporous polyethylene material with an embedded silica phase. Goretex 1 mm joint sealant, not shown, placed outside the separator perimeter provides a leak-tight seal. Continuously variable speed Masterflex tubing pumps 72 are used to circulate electrolyte between the reservoir and the cell. The flow-through anode assembly comprises a ⅜" graphite felt, marketed by Fiber Materials Corporation, bonded with a conductive adhesive to a 3/16" graphite plate, and the cathode is a graphite plate, also 3/16" thick, as will be described in detail hereinafter. The spacer 74 as shown in FIG. 1, also machined from acrylic, serves the dual purpose of providing mechanical separation, as well as a flow channel over the surface of the flow-by cathode.

Figure 5:
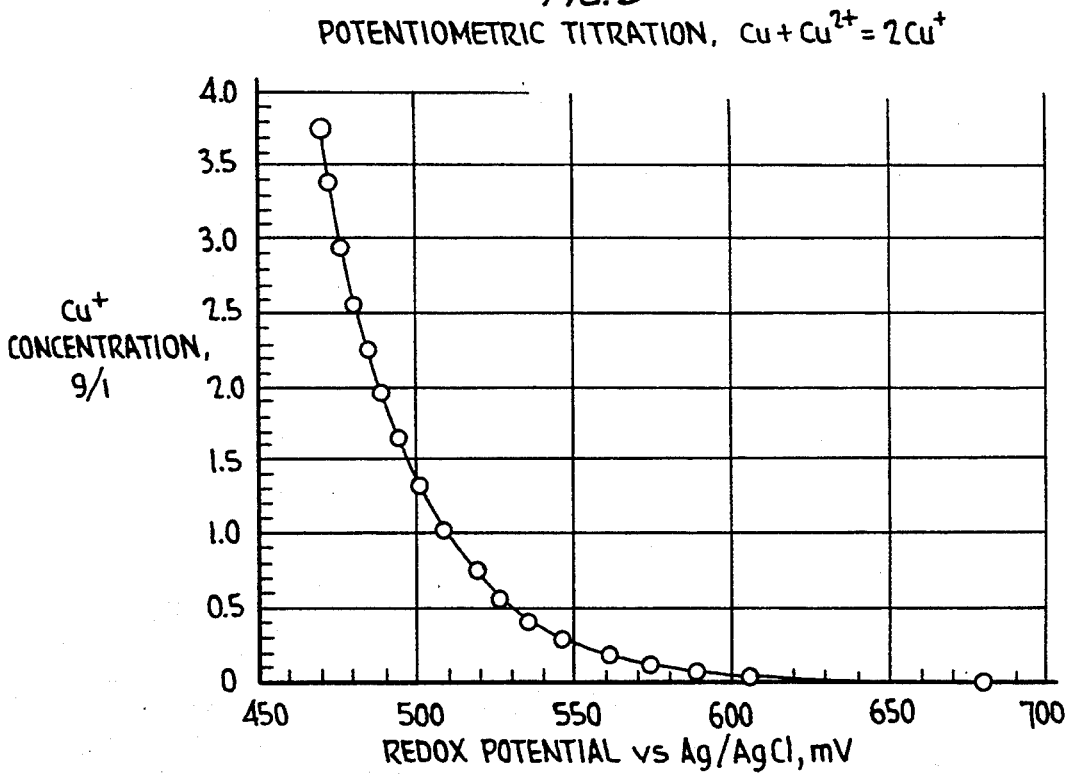
FIG. 5 shows a potentiometric titration curve, plotting $Cu^+$ concentration versus redox potential for an electrolyte solution consisting of a mixture of $CuCl_2$, CuCl and HCl temperature of around 50° C.

This flow loop system was designed to permit a variety of on-line measurements which will serve as prime process control parameters. Thus, the redox potential of the electrolyte is a direct measure of the ratio of $Cu^{2+}$ to $Cu^{+}$. This parameter, together with the total copper concentration in the electrolyte, determined titrimetrically, and a potentiometric titration curve, FIG. 5, for the addition of copper metal to a starting solution of $CuCl_2$ in HCl, provides an unambiguous measurement of both the $Cu^{2+}$ and $Cu^{+}$ concentrations. Accurate knowledge of the $Cu^{+}$ concentration is particularly important in order to maintain the anode potential within the specified range during electrolysis. The redox potential is conveniently measured by means of a platinum indicator electrode and a single junction Ag/AgCl reference electrode, as shown in FIG. 1.

The anode and cathode potentials can be similarly measured versus the Ag/AgCl electrode whether on open circuit or during the passage of current. The electrolyte path is through the return tubing 62 and 64 from the flow cell to the electrolyte reservoir 30. In spite of the relatively high resistance of this path (several feet), a stable and accurate reading is readily achieved using an electrometer 80 passing through a multiplexer 82 for recording on a strip chart recorder 83, as again shown in FIG. 1.

Other control and/or measurement points include the electrolyte composition and temperature, anolyte and catholyte flow rates, cell current and cell voltage. Cell voltage, along with the potential measurements discussed above, is conveniently recorded by means of the multiplexing system.

Figure 3:
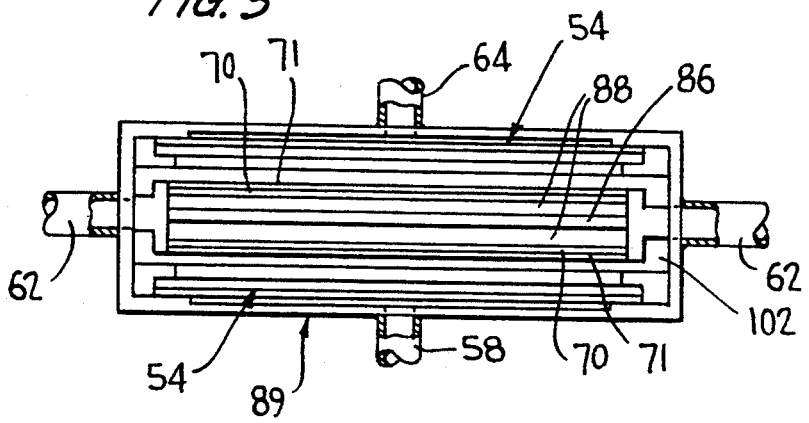
FIG. 3 is a plan view of a two-cell assembly as shown in greater detail in FIG. 4.
Figure 4:
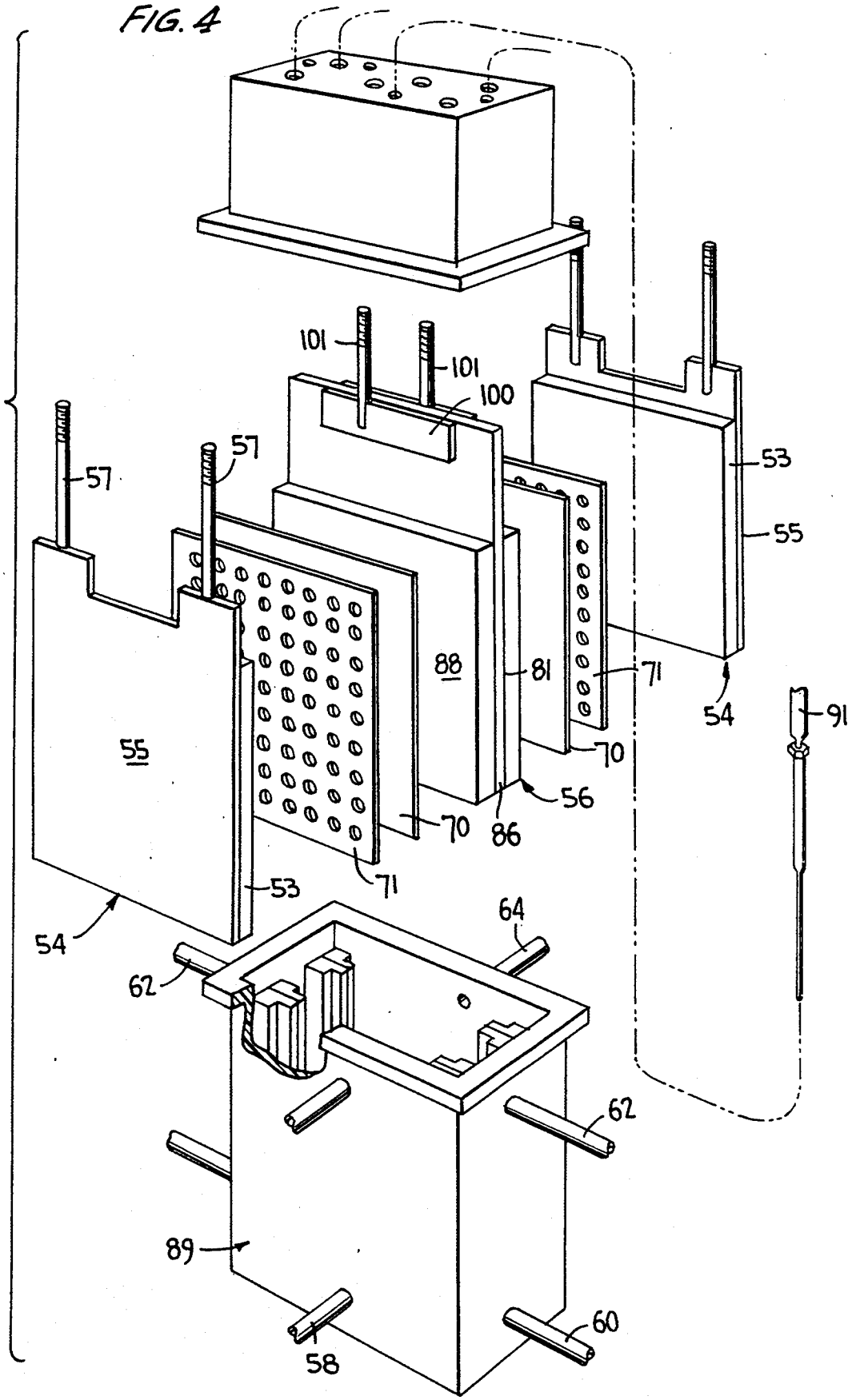
FIG. 4 is an exploded view of the cell assembly of FIG. 3.

Having described the general principles of the invention using the flow loop of FIG. 1, the invention will be further defined by reference to the flow-through anode shown in FIG. 2 and a two-cell system shown in FIGS. 3 and 4 as described in Example 1.

Example 1: Two-Cell Electrolyzer

The main components of the two-cell electrolyzer system are: (1) the electrolyte reservoir; (2) the electrolysis cell; and (3) the measurement system.

The electrolyte reservoir, which is the sump of an etching machine, comprises a covered, rectangular PVC vessel with a working capacity of 25 liters. The vessel is fitted with a 1 kW immersion heater, with temperature control to 50°±1.5° C., a level control and an emergency shutoff device, in case the temperature exceeds 60° C., the recommended maximum operating temperature for PVC. Inlet and outlet ports are provided for anolyte and catholyte flow, the inlet being by gravity feed from the cell. Two ports are provided for an Ag/AgCl reference electrode and a Pt indicator electrode, respectively, for measurement of the redox potential. An opening is provided in the cover for the periodic addition of copper foil to adjust the redox potential. Stirring is provided by means of a side loop with a 2 gpm pump.

The anode, as shown in FIGS. 2 and 4, consists of ⅜" graphite or carbon felt 88 bonded to each side of a 3/16" graphite current collector plate 86. The active area of each side of the felt is 77.4 $cm^2$. The anode current collector plate 86 extends upward for the attachment of titanium plates 100 and current collector feed-throughs 101. The anode assembly further comprises Daramic separator 70 and a perforated PVC or other plastic screen 71 which is adjacent to the cathode 54.

The electrolysis two-cell design is shown in FIGS. 3 and 4. The cell body 89 is fabricated from PVC. The cell has a central flow-through anode 56 and two flow-by cathodes 54, with each cathode separated from the anode assembly with a Daramic separator 70 and screen 71. The cathode 54 comprises a 3/16" graphite plate 53 attached to a titanium current collector 55 and feed-through leads 57.

The anode and cathode compartments, as shown in FIG. 3, are separated by PVC walls 102 extending substantially to the base of the cell and having windows cut out facing the anode and cathode surfaces. The width of the central anode compartment is about 1/16" smaller than the combined thickness of the anode felt and current collector plate so as to provide some compression on the felt, and thereby eliminate the possibility of any electrolyte "channeling."

Two inlet ports each, for electrolyte flow into the catholyte and anolyte flow distributor plenums, are situated at the base of the cell container, the cathode ports 58 being perpendicular to the face of the cathodes and the anode ports 60 perpendicular to the ends of the anodes. Electrolyte flow exits from the anode chamber at port 62 and from the cathode chambers at port 64 via overflow weirs positioned at the tops of the electrodes, directly above the inlet ports.

The anode and cathode operating potentials are measured versus a plurality of Ag/AgCl reference electrodes 91, as shown in FIG. 4. All other measurements and procedures are the same as employed in reference to the flow loop of FIG. 1.

Figure 6:
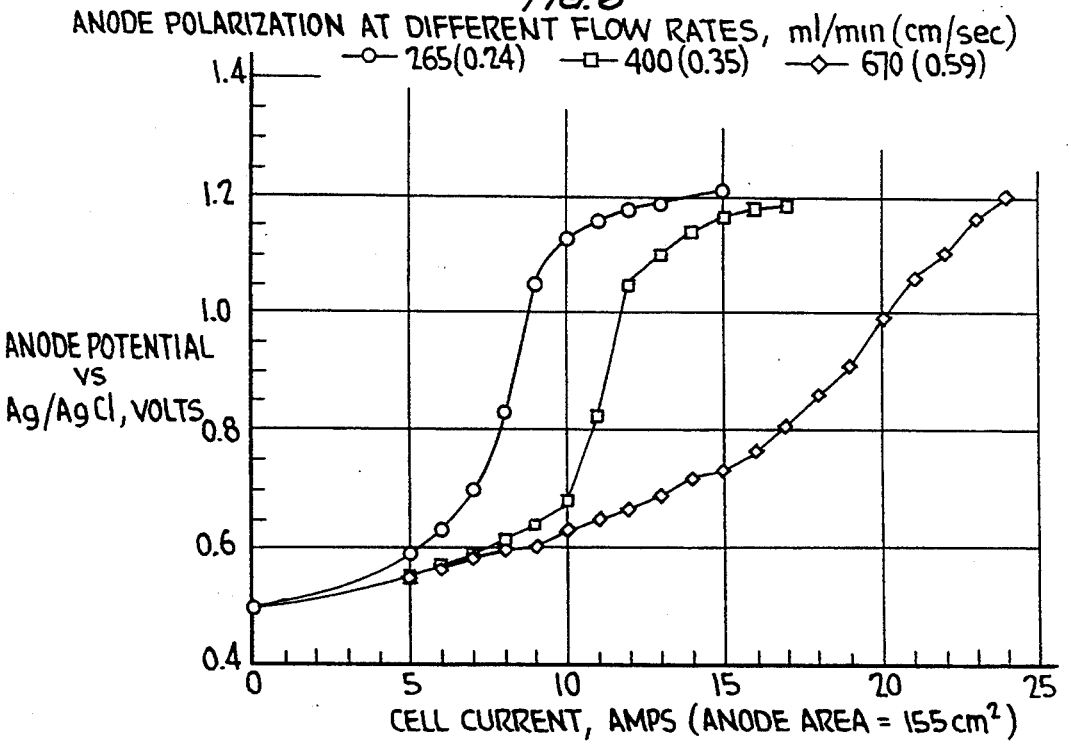
FIGS. 6 and 7 are steady state current/voltage curves which illustrate the performance of the anode and cathode, respectively.

FIG. 6 depicts anode polarization curves as a function of electrolyte flow rate through the graphite felt anodes of the two-cell electrolyzer of FIG. 4. The $Cu^{+}$ ion concentration was 1.5 g/l, corresponding to a redox potential of 495 mV (see FIG. 5). The $Cu^{2+}$ ion concentration was equal to 160 g/l and the HCl concentration was equal to 90 g/l. The electrolyte temperature was 50° C. These curves serve to illustrate the limiting current for the oxidation of $Cu^{+}$ to $Cu^{2+}$ ions and the effect of flow rate. The onset of chlorine evolution is seen to occur at around 1.2 volts versus Ag/AgCl.

Figure 7:
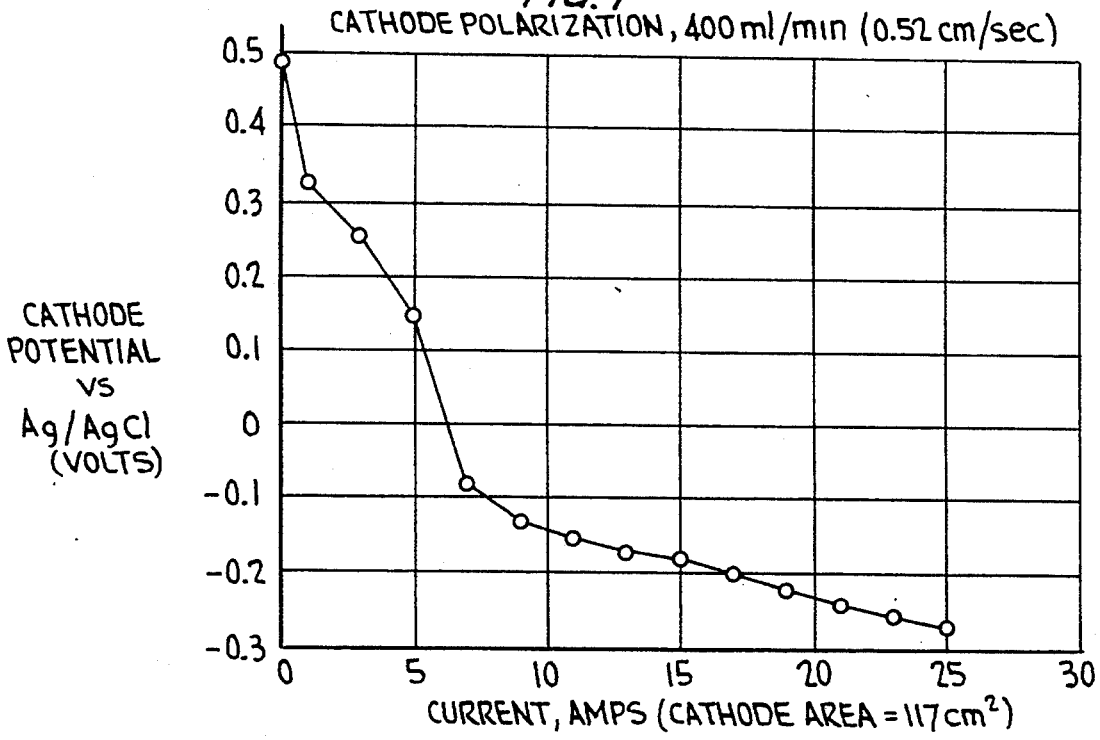

FIG. 7 depicts a cathode polarization curve also obtained in the two-cell electrolyzer and having the same electrolyte composition as above. The superficial cathode area was about 25% less than the superficial anode area, due to the fact that the former was partially masked in order to avoid plating either at the electrode edges or at two regions in the center of each of the graphite electrode plates where current collector contact bolts are placed. This cathode polarization curve clearly reveals a limiting current plateau between +0.4 and −0.1 volt versus Ag/AgCl corresponding to the reduction of $Cu^{2+}$ ions to $Cu^{+}$ ions. The reduction of $Cu^{+}$ to Cu metal then commences at around −0.15 volt versus Ag/AgCl.

It will be readily apparent from FIGS. 6 and 7 that the two-cell electrolyzer can be operated over quite a wide range of currents wherein the only anodic reaction is the oxidation of $Cu^{+}$ to $Cu^{2+}$ ions. Copper metal is deposited at the cathode at a potential about 0.4 volt positive to the hydrogen evolution potential, which in this system occurs at around −0.55 volt versus Ag/AgCl.

Figure 10:
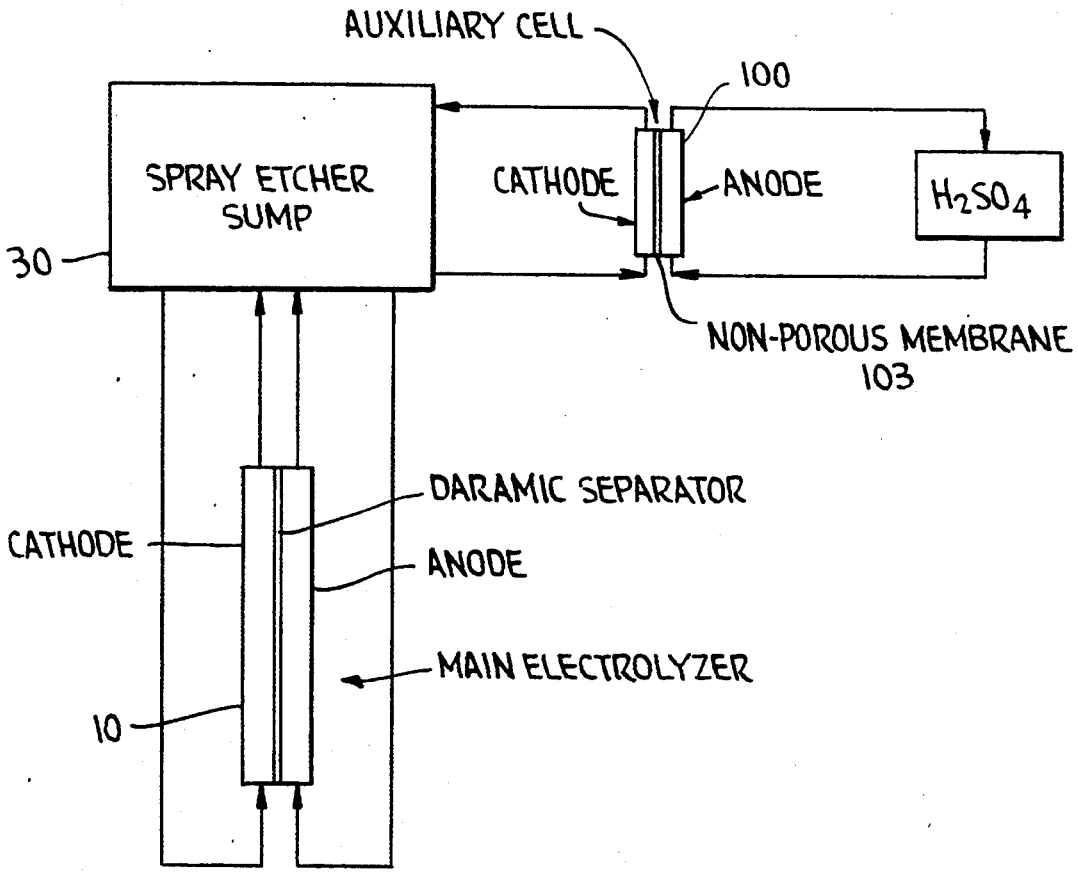
FIG. 10 is a schematic showing the auxiliary cell.
Figure 11:
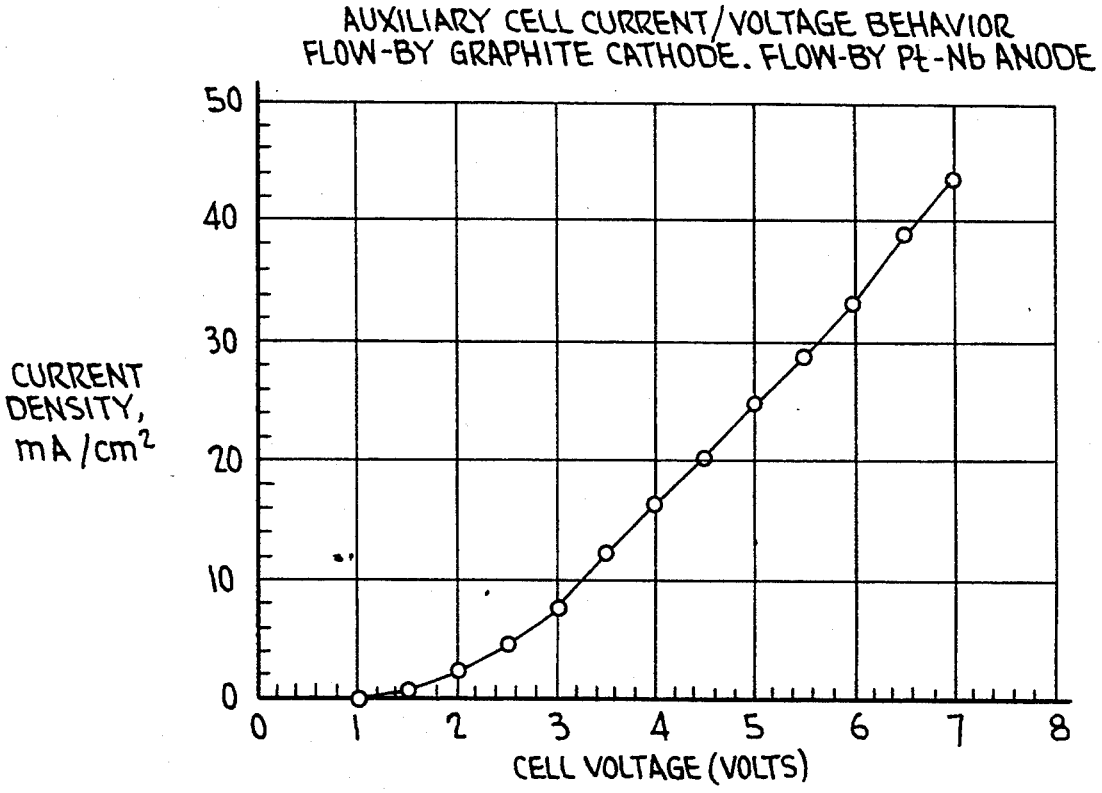
FIG. 11 is a current/voltage curve for operation of the auxiliary cell.

An auxiliary cell with separate anolyte and catholyte loops may be employed to compensate for oxygen ingress, as illustrated in the schematic of FIG. 10. As illustrated, the spray etcher sump 30, in addition to being connected to electrolyzer 10, is connected to auxiliary cell 100. The cell, not shown in detail, consists of two acrylic halves providing cavities for a graphite flow-by cathode and a Pt-clad niobium flow-by anode, separated by a suitable non-porous membrane 103. The cell cross-section area is 12.9 $cm^2$. There are separate temperature-controlled electrolyte reservoirs for the $H_2SO_4$ anolyte 104 and the $CuCl_2$ catholyte (the etcher sump 30), respectively, each having ports for electrolyte flow, reference and indicator electrodes, and temperature measurement, substantially as shown in FIG. 1. FIG. 11 illustrates the current/voltage behavior of such a cell. Above about 3 volts, the response is essentially ohmic with the current being limited only by the resistivity of the proton permeable membrane utilized in this cell.

There is a finite rate of chloride ion transfer into the sulfuric acid electrolyte when current is flowing. The chloride ion concentration in the sulfuric acid is easily monitored using a specific ion electrode. It was thus shown that a steady state concentration of no greater than $10^{-2}$M can be maintained. Chloride ions are continuously eliminated from the sulfuric acid via anodic oxidation to chlorine gas at the Pt/Nb anode. If so desired, the exit gases from the sulfuric acid could be scrubbed in NaOH to remove the small amount of chlorine which is liberated.

The on-line electrolytic regenerator of the present invention is highly effective. While not wanting to be bound by theory, the basic electrochemical rationale for the efficiency is based primarily on the use of a porous flow-through anode and a planar flow-by cathode. Thus, to achieve the objective of simply reversing the etching reaction, $Cu+CuCl_2=2CuCl$, and preserving the system's mass balance, it has been found essential that neither hydrogen nor chlorine evolution takes place. To achieve this, the first assumption is that a parallel plate design will be employed, so that the superficial, or apparent, cross section areas of the anode and cathode are equivalent. The second assumption is that the $CuCl_2$ concentration is high, a typical value being around 158 g/l, so that the $Cu^{++}$ concentration is correspondingly high. A high concentration is necessary in order to achieve sufficiently rapid etching rates. The third assumption is that the $Cu^{+}$ concentration is maintained low, i.e., 1–2 g/l. At $Cu^{+}$ concentrations higher than about 2 g/l, the etching rate decreases to unacceptable levels. A fourth assumption is that the redox potential be maintained at as nearly a constant level as possible. The redox potential, which is the potential measured at an inert indicator electrode such as platinum, gold or carbon is determined by the logarithmic ratio of the $Cu^{+}$ and $Cu^{++}$ ion concentrations, via the Nernst equation, and since the $Cu^{++}$ concentration will not vary by a significant percentage compared to the $Cu^{+}$ concentration, it is changes in the latter which will exert the greatest effect.

Figure 8:
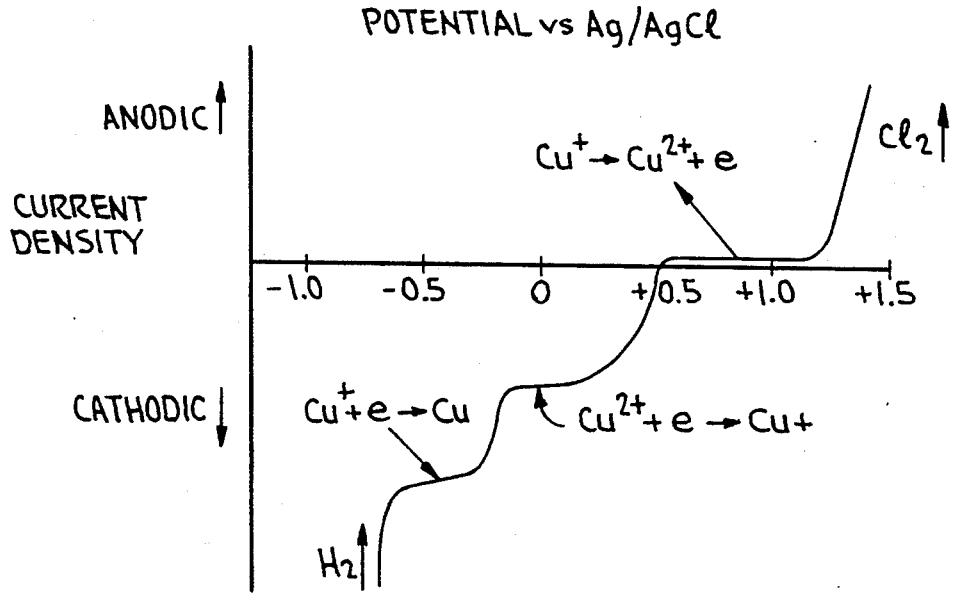
FIG. 8 is a simplified sketch of individual current/voltage curves for all the anodic and cathodic reactions possible in an electrolytic regeneration cell.

Having arrived at the above rationale, it is necessary to consider all of the electrode reactions which can take place in the system in terms of simple current/voltage relationships. FIG. 8 is a simplified sketch of the individual current/voltage curves for all of the cathodic and anodic reactions which could take place. For this representation the redox potential was 500 mV versus Ag/AgCl which corresponds to a $Cu^{+}$ concentration of about 1.3 g/l.

For the purpose of FIG. 8, it has been assumed that both electrodes are planar, flow-by electrodes made of graphite or carbon. Identical flow rates and superficial areas are assumed for each electrode. The current densities are in proportion to the concentrations of $Cu^{+}$, and $Cu^{2+}$ but, as apparent, most of the current for the reduction of $Cu^{+}$ results from $Cu^{+}$ formed by the prior reduction of $Cu^{2+}$. It is thus essential not to pass so high a current that the anode reaction goes into the chlorine evolution region. The maximum cell current density which can be employed using two planar flow-by electrodes as shown in FIG. 10 is still well below the limiting (plateau) current for the reduction of $Cu^{2+}$ to $Cu^{+}$. In other words, there would be no net electrolysis since the anode reaction would be simply reversed at the cathode.

As stated above, the $Cu^{2+}$ ion concentration in the etchant solution is approximately two orders of magnitude greater than the $Cu^{+}$ ion concentration. For the same flow rate at each electrode, the limiting current for $Cu^{2+}$ reduction to $Cu^{+}$ at the cathode will correspondingly be two orders of magnitude greater than the limiting current for $Cu^{+}$ oxidation to $Cu^{2+}$ at the anode. In order to compensate for this difference while still satisfying the requirement of exceeding the limiting current for reducing $Cu^{2+}$ to $Cu^{+}$ and not exceeding the limiting current for oxidation of $Cu^{+}$ to $C^{2+}$, it would be necessary to arrange for an increase of at least two orders of magnitude in the anolyte flow rate. However, such a high flow rate would be unmanageable in a practical system due to the severely increased pressure drops and pumping power as well as leakage and crossover problems which this would introduce.

Figure 9:
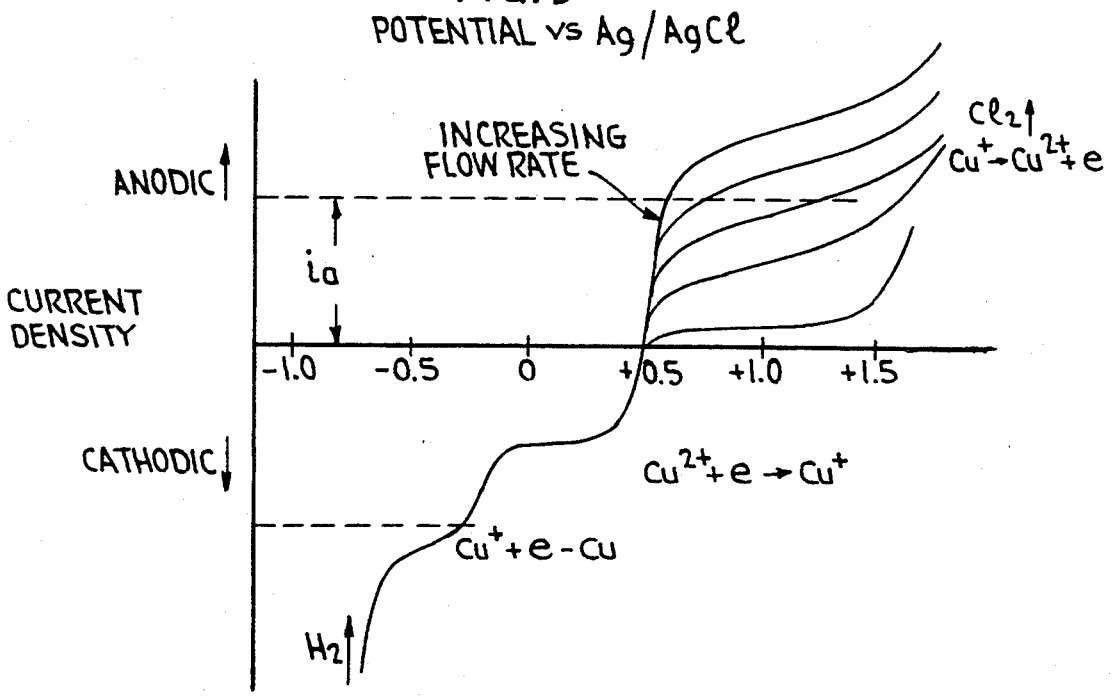
FIG. 9 illustrates a family of current/voltage curves for different electrolyte flow rates vertically through a flow-through anode.

FIG. 9 illustrates how a flow-through anode solves the problem and illustrates a family of anodic current/voltage curves for different electrolyte flow rates vertically through the anode. By flowing electrolyte through the porous structure, it is possible to make use of the high internal surface area of the structure. At the same time, since the current is diffusion limited, as shown it is possible to achieve higher currents at the higher flow rates. The same sort of increase is achieved if a thicker felt, i.e., one having a higher internal surface area, is used at constant flow rates. Accordingly, by choosing a suitable combination of felt thickness and flow velocity for the anode while maintaining low flow at the cathode, it is possible to exceed the limiting current for $Cu^{2+}$ reduction and thus achieve reduction all the way to copper metal.

As will be apparent to one skilled in the art, various modifications can be made within the scope of the aforesaid description. Such modifications being within the ability of one skilled in the art form a part of the present invention and are embraced by the appended claims.

It is claimed:

1. Process for electrolytic regeneration of an acid cupric chloride etching bath comprising (1) providing an electrolytic cell comprising a flow-through anode and means for flowing a liquid anolyte through said anode, and a planar cathode having means for contacting said planar cathode with a catholyte; (2) flowing a solution containing cuprous chloride (CuCl) through said anode to contact all of the interior surface of said anode and flowing the same solution into contact with said cathode; (3) maintaining the current density and potential of said anode and the current density and potential of said cathode so as to plate metallic copper from said catholyte at the cathode, and produce cupric chloride ($CuCl_2$) at said anode without hydrogen or chlorine evolution.

2. A regeneration system for the regeneration of an acid cupric chloride etching bath comprising, in combination, a reservoir containing an acid cupric chloride and an electrolytic cell, said electrolytic cell comprising a flow-through anode and a planar cathode; means for connecting said reservoir and said electrolytic cell whereby acid cupric chloride from said reservoir flows through said flow-through anode; means connecting said reservoir and said electrolytic cell whereby said planar cathode is contacted with an acid cupric chloride from said reservoir, and means for controlling the current density and potential at said anode and cathode within given ranges.

3. The regeneration system of claim 2 wherein said flow-through anode comprises a graphite current collector plate and a liquid flow-through graphite or carbon felt in contact with said current collector plate.

4. The regeneration system of claim 3 wherein said cathode is a graphite planar cathode.

5. The regeneration system of claim 4 wherein the cathode and the anode of said electrolytic cell have substantially the same cross sectional area but with the anode having greater surface area for fluid contact than said cathode as a result of the flow-through characteristic of the anode.

6. The regeneration system of claim 2 wherein the anode and cathode are separated by a microporous separator.

7. The regeneration system of claim 2 further including in combination an auxiliary cell connected to said reservoir for compensating for oxygen ingress into said system, said auxiliary cell comprising an anode, a cathode, an electrolyte separating said anode and cathode and means for flowing acid cupric chloride to and from said auxiliary cell and said reservoir.

* * * * *